US009053598B2

(12) United States Patent
Horigome

(10) Patent No.: US 9,053,598 B2
(45) Date of Patent: Jun. 9, 2015

(54) BANKNOTE PROCESSING DEVICE

(71) Applicant: Oki Electric Industry Co., Ltd., Tokyo (JP)

(72) Inventor: Yuuta Horigome, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/233,151

(22) PCT Filed: Oct. 3, 2012

(86) PCT No.: PCT/JP2012/075699
§ 371 (c)(1),
(2) Date: Jan. 15, 2014

(87) PCT Pub. No.: WO2013/080656
PCT Pub. Date: Jun. 6, 2013

(65) Prior Publication Data

US 2014/0216888 A1 Aug. 7, 2014

(30) Foreign Application Priority Data

Nov. 30, 2011 (JP) ..... 2011-261195

(51) Int. Cl.
*G07F 7/04* (2006.01)
*G07F 9/02* (2006.01)
(Continued)

(52) U.S. Cl.
CPC ..... *G07D 11/0039* (2013.01); *G07D 11/0021* (2013.01); *G07F 7/04* (2013.01);
(Continued)

(58) Field of Classification Search
CPC .. G07D 11/0039; G07D 11/0021; G07F 7/04; G07F 19/20; G07F 19/202
USPC ..... 194/200, 206, 207; 209/534; 235/379; 271/1
See application file for complete search history.

(56) References Cited

U.S. PATENT DOCUMENTS

| | | | | |
|---|---|---|---|---|
| 7,673,874 | B2 * | 3/2010 | Arai et al. | 271/258.01 |
| 2005/0056519 | A1 * | 3/2005 | Yokoi et al. | 194/206 |
| 2010/0245043 | A1 | 9/2010 | Doi et al. | |

FOREIGN PATENT DOCUMENTS

| | | | |
|---|---|---|---|
| JP | H02-230493 | A | 9/1990 |
| JP | 2001-093022 | A | 4/2001 |

(Continued)

OTHER PUBLICATIONS

Russian Office Action with translation dated Feb. 19, 2015, 2014101499—5pgs.
Japanese Office Action with translation dated Apr. 21, 2015, 2011-261175—4pgs.

*Primary Examiner* — Mark Beauchaine
(74) *Attorney, Agent, or Firm* — Rabin & Berdo, P.C.

(57) ABSTRACT

A banknote processing device that stacks banknotes in a banknote storage section even when a jam occurs. The device has an insertion aperture, a verification section, the storage section and a controller. The aperture separates and feeds inserted banknotes. The verification section verifies the banknotes fed from the aperture. The banknotes are stacked in the storage section. The controller controls conveyance of the banknotes conveyed from the aperture to the verification section such that, depending on verification results, the banknotes are conveyed directly to the storage section. When a jam occurs during conveyance of the banknotes, the controller stops the separation and feeding of the banknotes from the aperture, and controls conveyance such that banknotes for which the storage section has been set as a conveyance destination by the verification section are conveyed directly to the storage section and banknotes for which no conveyance destination has been set are ejected.

7 Claims, 11 Drawing Sheets

(51) Int. Cl.

| | |
|---|---|
| ***G07D 11/00*** | (2006.01) |
| ***G07F 19/00*** | (2006.01) |
| ***B65H 29/60*** | (2006.01) |

(52) U.S. Cl.

CPC ..... *G07F 19/20* (2013.01); *B65H 29/60* (2013.01); *B65H 2511/528* (2013.01); *B65H 2301/4318* (2013.01); *G07D 11/0066* (2013.01); *G07D 11/0075* (2013.01)

(56) References Cited

FOREIGN PATENT DOCUMENTS

| | | | |
|---|---|---|---|
| JP | 2005-202491 | A | 7/2005 |
| JP | 2006-065539 | A | 3/2006 |
| JP | 2008-171274 | A | 7/2008 |
| JP | 2010-224738 | A | 10/2010 |
| JP | 2011-134222 | A | 7/2011 |

* cited by examiner

BANKNOTE PROCESSING DEVICE

TECHNICAL FIELD

The present invention relates to a banknote processing device.

BACKGROUND ART

Heretofore, cash processing devices, as represented by service counter cash processors installed at the counters of service branches of financial institutions, have been used for banknote and coin deposit and withdrawal transactions, and for account updates and the like. A staff member may carry out transactions such as deposits, withdrawals and the like by performing various operations from an operation unit of a cash processing device or from a service terminal (information processing device) connected to the cash processing device.

This cash processing device may be disposed between two tellers (operators), and deposits and withdrawals of banknotes and coins may be carried out by the two tellers. Japanese Patent Application Laid-Open (JP-A) No. 2001-93022 discloses a circulation type currency processor with a structure in which, when the device is disposed between and used by two tellers, the disposition of a banknote deposit aperture and suchlike can be altered so as to make operations easier for either of the two tellers at left and right.

Beside service counter cash processors, the above-mentioned cash processing device architecture may be applied to a cash processing unit of an automated teller machine (ATM), as represented by an ATM in a financial institution. JP-A No. 2010-224738 discloses an operation of a coin processing device in an ATM, which operation is a direct coin deposit in which received coins are fed to a coin storage chute and ultimately to a coin storage cassette directly, rather than being temporarily held in a temporary holding section.

SUMMARY OF INVENTION

Technical Problem

In a banknote processing device that deals with banknotes, cash processing times may be shortened by, similarly to the above-described direct coin deposit, conveying banknotes directly to banknote cassettes without temporarily holding the banknotes at a temporary holding section. Further, when banknotes are re-stocked through a deposit aperture, the cash processing time may be shortened by directly conveying the banknotes inserted through the deposit aperture to banknote cassettes of the corresponding denominations.

In regard to processing when there is a conveyance failure during the conveyance of banknotes, due to jamming or the like, JP-A No. 2011-134222 recites a technology in which jammed notes are fed out by an operation knob being turned by hand.

However, apart from jammed notes, JP-A No. 2011-134222 does not discuss conveyance control of banknotes during conveyance. Moreover, there have been no proposals in the related art in regard to responding to occurrences of jamming in processing that conveys inserted banknotes from a deposit aperture (insertion aperture) directly to banknote cassettes, as in the above-mentioned direct deposit.

Accordingly, the present invention has been made in consideration of the problem described above, and an object of the present invention is to provide a new and improved banknote processing device that may stack banknotes in a banknote storage section even when a jam has occurred.

Solution to Problem

In order to solve the problem described above, in accordance with an aspect of the present invention, provided is a banknote processing device that includes: an insertion aperture that separates and feeds inserted banknotes; a banknote verification section that verifies the banknotes fed from the insertion aperture; a banknote storage section in which the banknotes are stacked; and a controller that controls conveyance of the banknotes conveyed from the insertion aperture to the banknote verification section such that the banknotes are conveyed directly to the banknote storage section in accordance with verification results by the banknote verification section, wherein, when a jam occurs in the process of conveying the banknotes, the controller stops the separation and feeding of the banknotes by the insertion aperture, and controls conveyance such that banknotes for which the banknote storage section has been set as a conveyance destination by the banknote verification section are conveyed directly to the banknote storage section and banknotes for which no conveyance destination has been set are ejected.

When the jam occurs in the process of conveying the banknotes, the controller may control conveyance so as to eject banknotes that have been verified as abnormal by the banknote verification section and set to be ejected from an ejection aperture.

When the cause of the jam has been removed and the banknote processing device has been restarted, the controller may perform conveyance control to convey banknotes of a non-returned portion from the banknote storage section to the banknote verification section.

A comparison section may be provided that compares characteristic information recognized at the time of a first conveyance from the insertion aperture to the banknote verification section with characteristic information recognized at the time of a second conveyance by the conveyance control from the banknote storage section to the banknote verification section.

A memory may be provided that, when the comparison section determines that the characteristic information recognized at the time of the second conveyance is different from the characteristic information recognized at the time of the first conveyance, memorizes a characteristic information error, wherein the conveyance controller controls conveyance such that the banknotes conveyed from the banknote storage section to the banknote verification section are ejected regardless of the results of the comparison by the comparison section.

Advantageous Effects of Invention

According to the present invention as described hereabove, banknotes may be stacked in a banknote storage section even when a jam occurs.

DESCRIPTION OF EMBODIMENTS

Figure 1:
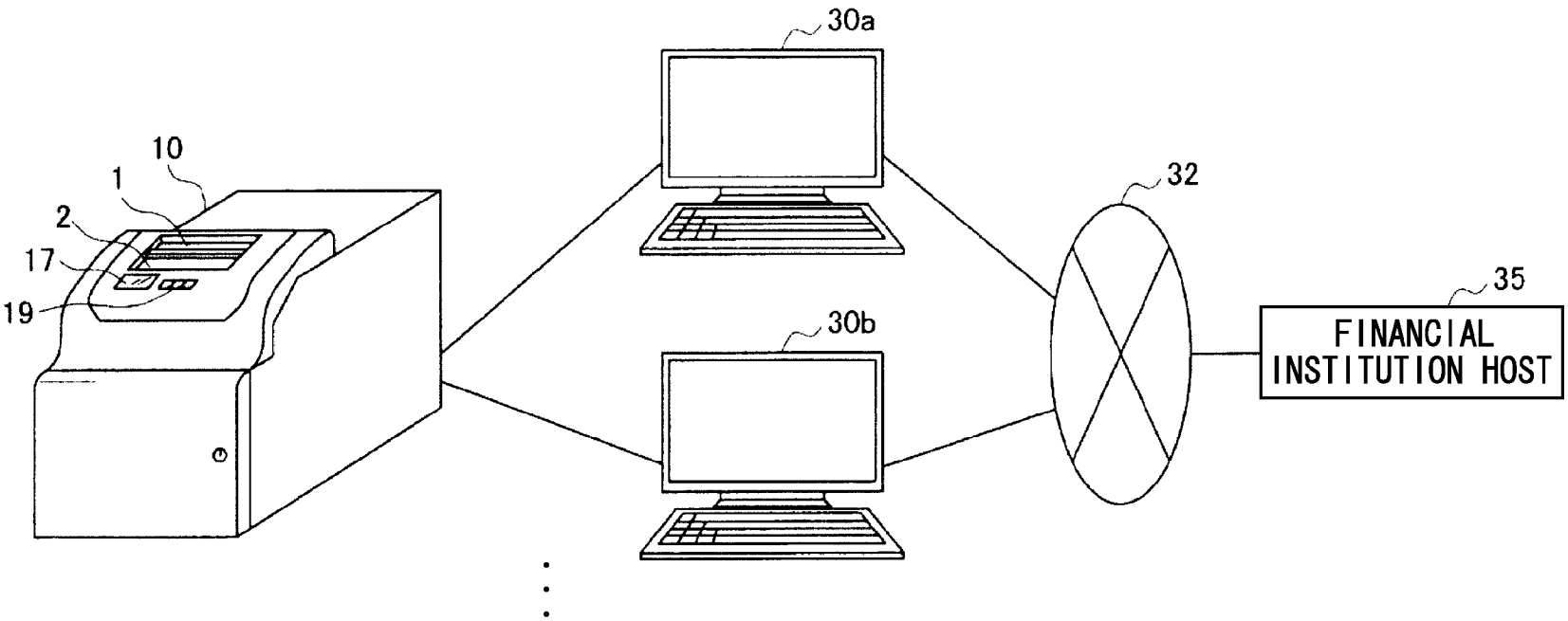
FIG. 1 is a descriptive diagram showing structures of a banknote processing system in accordance with an embodiment of the present invention.

Herebelow, a preferable embodiment of the present invention is described in detail while referring to the attached drawings. In the present specification and drawings, structural elements with substantially the same functional structures are assigned the same reference numerals, and duplicative descriptions thereof are omitted accordingly.

1. OUTLINE OF BANKNOTE PROCESSING SYSTEM

First, general features of a banknote processing system in accordance with an embodiment of the present invention are described with reference to FIG. 1.

FIG. 1 is a descriptive diagram showing structures of the banknote processing system according to the embodiment of the present invention. As shown in FIG. 1, the banknote processing system includes a banknote processing device 10, service terminals 30*a* and 30*b* that are connected to the banknote processing device 10, a dedicated network 32, and a financial institution host 35. In the example shown in FIG. 1, plural service terminals 30 are connected to the banknote processing device 10. However, a banknote processing system in accordance with the present embodiment is not limited thus: a single service terminal 30 may be connected to the banknote processing device 10. Each service terminal 30 is also connected to the financial institution host 35 via the dedicated network 32.

The banknote processing device 10 is a staff-operated terminal that executes cash transactions in accordance with operations by staff members such as the front counter staff of the financial institution. The banknote processing device 10 is installed in a service branch of the financial institution or the like.

As shown in FIG. 1, the banknote processing device 10 is equipped with a deposit aperture 1 at which banknotes are inserted, a withdrawal aperture 2 at which banknotes are ejected, a display unit 17, and an operation unit 19. The display unit 17 displays menu screens, processing result screens and the like. The display unit 17 is implemented with, for example, a cathode ray tube (CRT) display device, a liquid crystal display (LCD) device or an organic light-emitting diode (OLED) device. The operation unit 19 detects operations by a staff member. The operation unit 19 is implemented with, for example, buttons, switches and a touch panel or the like. In FIG. 1, the display function and the operation function are provided separately, but the banknote processing device 10 in accordance with the present embodiment is not limited thus. The display function and the operation function may be integrally provided. The banknote processing device 10 may display guidance screens guiding operations by a staff member at a display screen that features an operation detection function.

The deposit aperture 1 is an insertion aperture at which the staff member inserts banknotes. The deposit aperture 1 is provided with a shutter (not shown in the drawings) that opens and closes an opening portion. The deposit aperture 1 features a separation function that separates banknotes inserted in a bundle and feeds the banknotes one by one.

The withdrawal aperture 2 is an ejection aperture at which banknotes to be collected by the staff member are ejected. The withdrawal aperture 2 is provided with a shutter (not shown in the drawings) that opens and closes an opening portion. The withdrawal aperture 2 features a stacking function that stacks the banknotes being ejected.

Each service terminal 30 is an information processing device that executes service tasks. The service terminal 30 is connected with the banknote processing device 10 by wire or by wireless, and sends commands such that processing modes selected by the staff member (deposit and withdrawal transactions, withdrawal aperture recoveries, account updates and the like) are executed by the banknote processing device 10. Thus, the banknote processing device 10 according to the present embodiment may be operated from an information processing device connected to the banknote processing device 10 as well as from the aforementioned operation unit 19 provided at the banknote processing device 10.

The dedicated network 32 is a network in the service branch at which the service terminals 30 are provided, or in the financial institution covering plural service branches. The dedicated network 32 is constituted by, for example, an IP-VPN (Internet protocol virtual private network). The financial institution host 35 may communicate with the plural service terminals 30 via the dedicated network 32.

The financial institution host 35 controls various transactions by communicating with each service terminal 30 via the dedicated network 32 or communicating with the banknote processing device 10 via the service terminal 30. For example, the financial institution host 35 authenticates customers and executes cash transactions (account transaction processing) such as deposits, transfers and the like that are instructed by the staff member. The financial institution host 35 also administers customer information (an account ledger) such as an account number, PIN number, name, address, age, birth date, telephone number, occupation, household members, income, deposit balance and so forth.

An embodiment of the present invention relates to the banknote processing device 10 included in the banknote processing system described hereabove, and particularly relates to control of returns of deposited banknotes in the banknote processing device 10. Herebelow, the structure and basic operations of the banknote processing device 10 are described, after which deposited banknote return control in accordance with the embodiment of the present invention is described in detail.

<Structure and Basic Operations of the Banknote Processing Device 10>

—2-1. Internal Structures—

Figure 2:
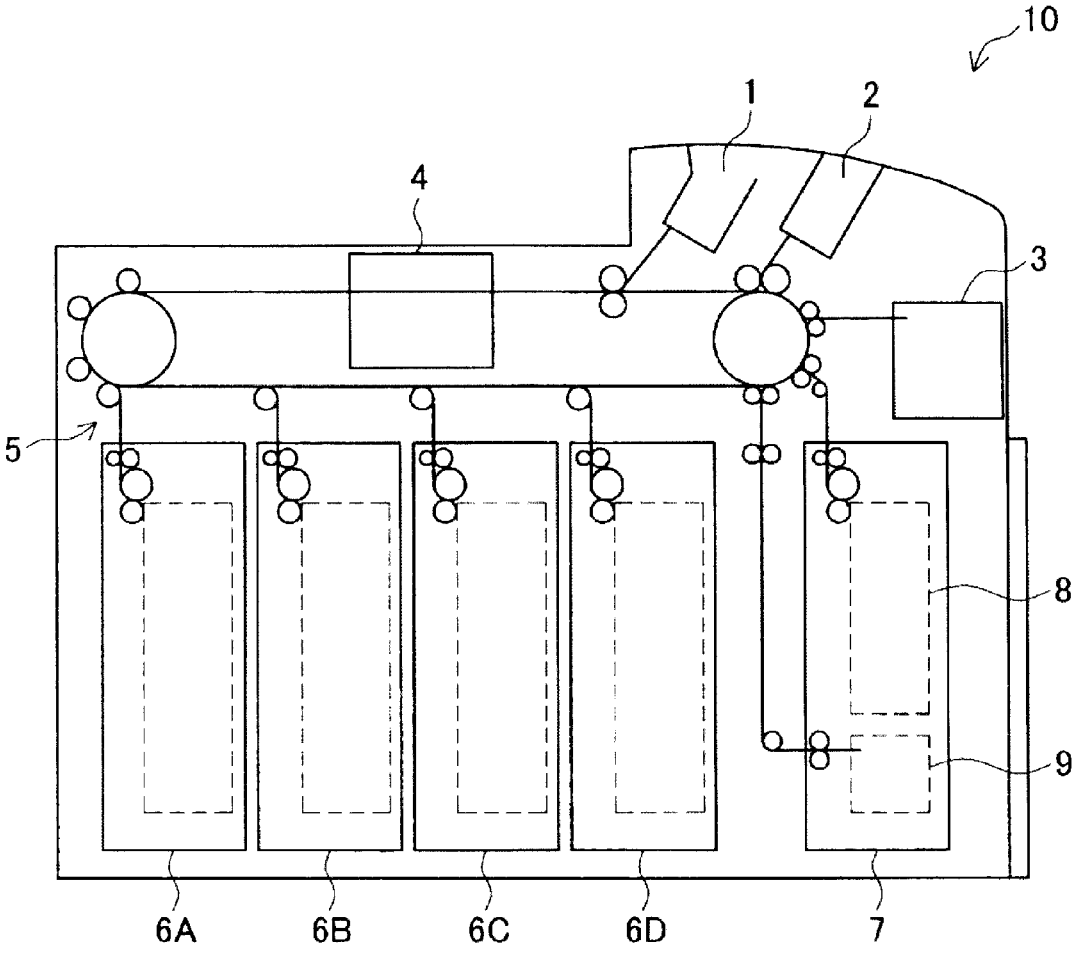
FIG. 2 is a diagram showing internal structures of a banknote processing device in accordance with the embodiment of the present invention.

FIG. 2 is a diagram showing internal structures of the banknote processing device 10. As shown in FIG. 2, the banknote processing device 10 includes the deposit aperture 1, the withdrawal aperture 2, a temporary holding section 3, a banknote verification section 4, a conveyance section 5, banknote cassettes 6A to 6D, and a banknote cassette with a reject vault 7. The banknote cassette with a reject vault 7 includes a banknote storage vault 8 and a reject vault 9.

As described above, the deposit aperture 1 features a separation function that feeds inserted banknotes one by one and, as described above, the withdrawal aperture 2 features a stacking function that stacks banknotes to be ejected. The deposit aperture 1 and withdrawal aperture 2 may be movable such that they may be angled to the side of a conveyance path, angled to the side of a loading aperture for a staff member, and the like.

The temporary holding section 3 features functions of both separation and stacking of banknotes. For example, during a deposit transaction, the temporary holding section 3 temporarily stacks banknotes that have been separated from the deposit aperture 1 and identified as proper by the banknote verification section 4. When the transaction is completed, such as when an account total of the deposited banknotes or the like is confirmed or the like, the banknotes stacked in the temporary holding section 3 are fed out and are conveyed through the banknote verification section 4 to the banknote cassettes 6A to 6D or the like. The temporary holding section 3 may be of a stacking type in which banknotes are successively superposed and stacked, or may be of a drum type in which banknotes are successively wound on to be stored.

The banknote verification section 4 authenticates banknotes passing therethrough one by one. The banknote verification section 4 can deal with banknotes progressing in both directions: it may authenticate banknotes being conveyed in the direction from the deposit aperture 1 and banknotes being conveyed in the opposite direction. To be specific, the banknote verification section 4 identifies the denomination of a banknote being conveyed along the conveyance path, whether the banknote is authentic or not, whether the banknote is intact or damaged, a traveling state of the banknote, and the like. Thus, the banknote verification section 4 determines whether a banknote passing through is proper or a reject. A reject determination can be based on factors such as inauthenticity, damage (staining, tearing, abnormal shape or the like), and traveling problems (a skewed banknote, double-feeding and the like). Reject banknotes may also include 2,000 yen notes and 5,000 yen notes where these cannot be used as withdrawal banknotes, and may include foreign banknotes.

The conveyance section 5 includes conveyance paths that convey the banknotes, conveyance rollers, and driving mechanisms that drive the conveyance paths. A driving mechanism drives a conveyance path by, for example, rotation of a DC servo motor or a pulse motor or the like. The conveyance section 5 is controlled by a controller, which is described below (see a controller 11 in FIG. 3), and conveys the banknotes to target conveyance destinations.

The banknote cassettes 6A to 6D are banknote storage sections in which banknotes can be stored in respective denominations, and feature functions of both stacking and separating banknotes. The banknote cassettes 6A to 6D may include a plural number of cassettes that store the same denomination. For example, the banknote cassettes 6A and 6C may be banknote cassettes for 10,000 yen notes and the banknote cassettes 6B and 6D may be banknote cassettes for 1,000 yen notes. The banknote cassettes 6A to 6D may be structures that can be mounted at and removed from the banknote processing device 10, and banknotes may be loaded in the banknote cassettes 6A to 6D by the banknote cassettes 6A to 6D being replaced as units. Note that a banknote storage section according to the present embodiment is not limited to cassettes that can be mounted at and removed from the banknote processing device 10, but may be stackers (banknote stackers A to D) that cannot be mounted at and removed from the banknote processing device 10.

The banknote cassette with a reject vault 7 (which is also referred to hereinafter as "the banknote cassette 7") is equipped with the banknote storage vault 8 at the upper side thereof and the reject vault 9 at the lower side (a floor portion) thereof. The banknote cassette 7 is a structure that can be mounted at and removed from the banknote processing device 10, and banknotes may be recovered and re-stocked by the banknote cassette 7 being replaced as a unit.

The banknote storage vault 8 features the stacking function that stacks banknotes and the separation function that feeds banknotes one by one. The banknote storage vault 8 stacks banknotes separated from the banknote cassettes 6A to 6D at a time of cassette counting and recovery, and may recover these banknotes. For cassette counting and re-stocking, the banknote storage vault 8 may feed stored banknotes and re-stock the banknotes in the banknote cassettes 6. That is, the banknote storage vault 8 is a general-purpose banknote storage section that may be used for multiple purposes.

The reject vault 9 features only the stacking function that stacks banknotes. The reject vault 9 is a banknote storage section for stacking banknotes (reject banknotes) identified as abnormal by the banknote verification section 4 (reject determination).

Hereabove, the internal structures of the banknote processing device 10 included in the banknote processing system according to the present embodiment are described in detail. Now, functional structures of the banknote processing device 10 according to the present embodiment are described.

—2-2. Functional Structures—

Figure 3:
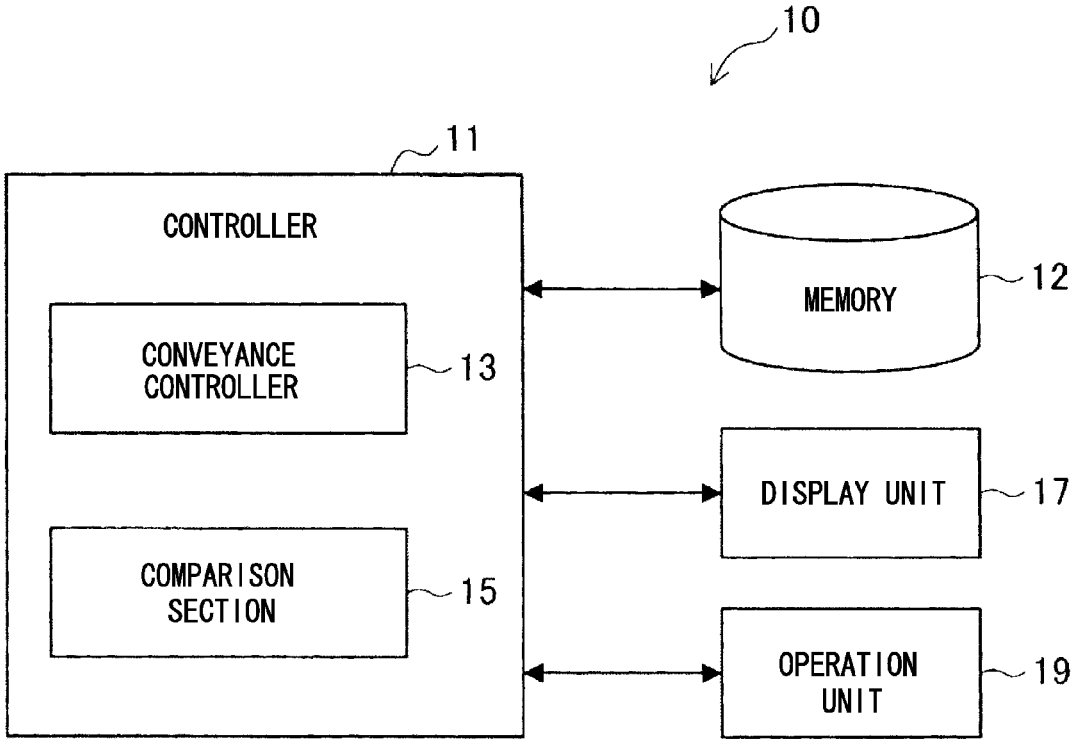
FIG. 3 is a block diagram showing functional structures of the banknote processing device in accordance with the embodiment of the present invention.

FIG. 3 is a block diagram showing the functional structures of the banknote processing device 10 according to the present embodiment. As shown in FIG. 3, the banknote processing device 10 is provided with the controller 11, a memory 12, the display unit 17 and the operation unit 19. The respective structures are described herebelow. However, the display unit 17 and the operation unit 19 have been described with reference to FIG. 1, so descriptions thereof are not given here.

The controller 11 controls overall operations of the banknote processing device 10. Specifically, the controller 11 controls basic operations such as deposits, withdrawals, recoveries and account updates. Details of these basic operations are described below in section "2-3. Basic Operations". The controller 11 also controls the banknote processing device 10 as a whole so as to execute basic operations instructed by a staff member through the operation unit 19 and basic operations instructed by a staff member through the service terminal 30.

The controller 11 according to the present embodiment functions as a conveyance controller 13 and a comparison section 15. By controlling the conveyance section 5, the conveyance controller 13 controls conveyances of banknotes in basic operations such as deposits, withdrawals, recoveries and account updates. The conveyance controller 13 stops the separation and feeding of banknotes by the deposit aperture 1 when a jam (a conveyance failure) occurs during a direct deposit. The conveyance controller 13 performs control to directly convey banknotes for which one of the banknote cassettes 6 has been set as a conveyance destination by the banknote verification section 4 to the banknote cassette 6, and to convey banknotes for which no conveyance destination has been set to the withdrawal aperture 2 to be ejected.

The conveyance controller 13 may also control a return of deposited banknotes in accordance with results of comparisons by the comparison section 15. The comparison section 15 compares serial numbers of banknotes being returned with the serial numbers of deposited banknotes. Banknote conveyance control by the conveyance controller 13 when a jam occurs is described in detail herebelow, in the section "3-1. Banknote Conveyance Control When a Jam Occurs".

The memory 12 memorizes the serial numbers of deposited banknotes, which are recognized by the banknote verification section 4. When the serial number of a banknote being returned is determined by the comparison section 15 to be different from the serial number of the deposited banknote, the memory 12 memorizes a serial number error.

Hereabove, the functional structures of the banknote processing device 10 according to the present embodiment are described. The functions of the above-described controller 11 (the conveyance controller 13 and the comparison section 15) and the memory 12 may be realized by a hardware structure formed of a central processing unit (CPU), read-only memory (ROM), random access memory (RAM) and suchlike. The CPU features computation functions and control functions, and controls overall operations of the banknote processing device 10 in accordance with various programs. The ROM memorizes programs, computation parameters and the like to be used by the CPU. The RAM temporarily memorizes programs used for execution by the CPU, parameters that are altered as appropriate in the execution of programs, and the like.

—2-3. Basic Operations—

—Deposit Transaction—

Figure 4:
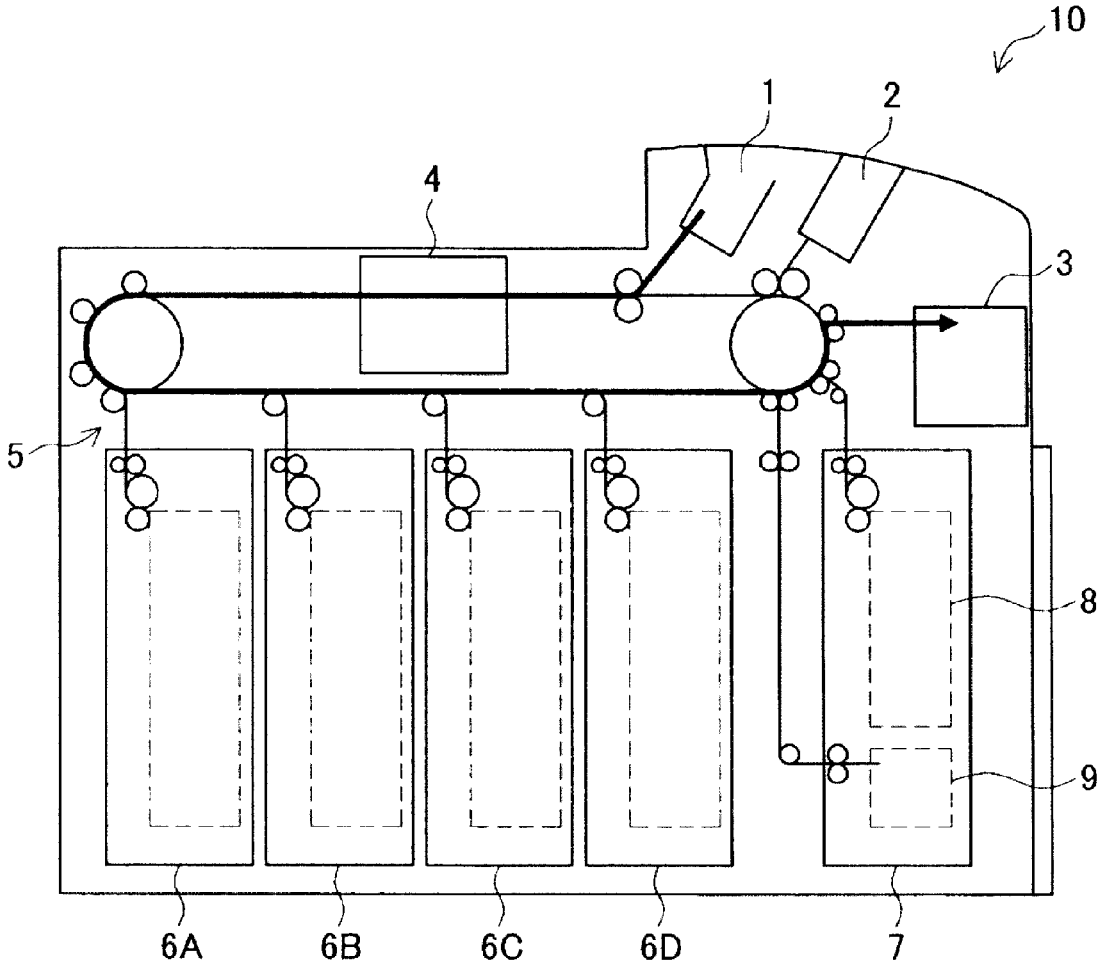
FIG. 4 is a diagram showing a conveyance path of a banknote that has been verified as proper by a verification result according to a banknote verification section.
Figure 5:
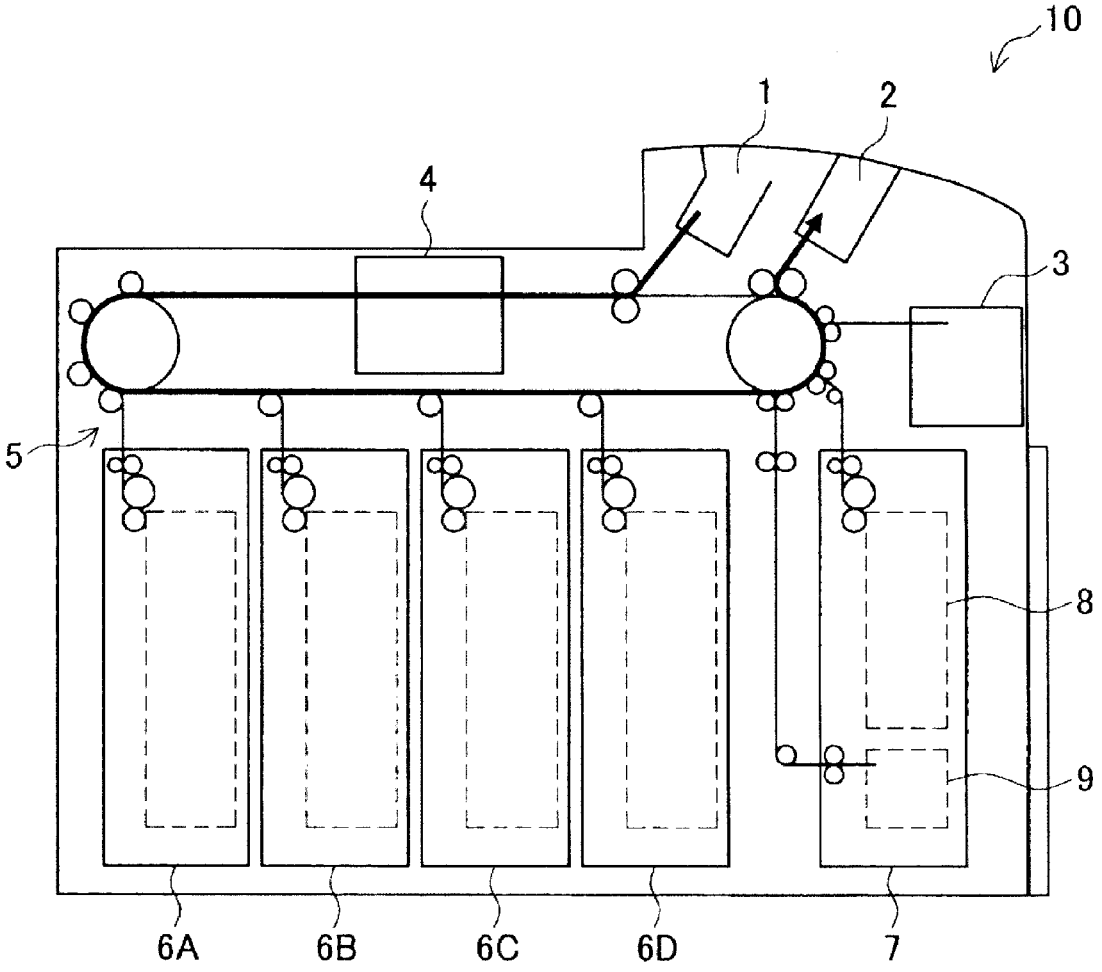
FIG. 5 is a diagram showing a conveyance path of a banknote that has been verified as abnormal (a reject banknote) by a verification result according to a banknote verification section.

A deposit transaction is described with reference to FIG. 4 and FIG. 5. FIG. 4 is a diagram showing a conveyance path, in the deposit transaction, of a banknote that has been verified as proper by a verification result according to the banknote verification section 4. FIG. 5 is a diagram showing a conveyance path, in the deposit transaction, of a banknote that has been verified as abnormal (a reject banknote) by a verification result according to the banknote verification section 4.

In the deposit transaction, banknotes are separated one by one from the deposit aperture 1, and each separated banknote is conveyed to the banknote verification section 4. A banknote for which the result of verification by the banknote verification section 4 is that the banknote is proper passes along the conveyance path shown by the arrow in FIG. 4 from the banknote verification section 4 and is stacked in the temporary holding section 3. On the other hand, a banknote for which the result of verification by the banknote verification section 4 is that the banknote is abnormal (a reject banknote) passes along the path shown by the arrow in FIG. 5 and is stacked in the withdrawal aperture 2. Banknotes stacked in the withdrawal aperture 2 may be re-inserted at the deposit aperture 1 by a staff member and re-verified. Subsequently, when a deposit amount is confirmed, the banknote processing device 10 advances to stacking processing.

In the stacking processing, the banknotes are separated one by one from the temporary holding section 3, and each separated banknote is conveyed to the banknote verification section 4. A banknote for which the result of verification by the banknote verification section 4 is that the banknote is proper is stacked in the banknote cassettes 6A to 6D in accordance with the denomination thereof. On the other hand, a banknote for which the result of verification by the banknote verification section 4 is that the banknote is abnormal (a reject banknote)—such as a damaged 10,000 yen note or 1,000 yen note, a folded note, a 2,000 yen note or 5,000 yen note, or a banknote whose traveling state is skewed or the like—is stacked in the reject vault 9.

Alternatively, if a return of the deposited banknotes (a cancellation) is instructed before a deposit amount is confirmed, the banknote processing device 10 switches to return processing. In the return processing, the banknotes are separated one by one from the temporary holding section 3, and the separated banknotes are conveyed to the banknote verification section 4. Regardless of whether the results of verification by the banknote verification section 4 are proper or abnormal, all of the banknotes are stacked in the withdrawal aperture 2.

—Withdrawal Transaction—

In the withdrawal transaction, banknotes are separated one by one from the banknote cassettes 6A to 6D in accordance with a specified amount, and the separated banknotes are conveyed to the banknote verification section 4.

A banknote for which the result of verification by the banknote verification section 4 is that the banknote is proper is stacked in the withdrawal aperture 2. On the other hand, a banknote for which the result of verification by the banknote verification section 4 is that the banknote is abnormal, which is to say a banknote that may not be paid to the customer, is stacked in the reject vault 9.

—Re-Stocking Operation—

The re-stocking operation is a basic operation for re-stocking banknotes in the banknote processing device 10. In the banknote processing device 10 according to the present embodiment, insertion aperture re-stocking, cassette replacement re-stocking and cassette counting re-stocking are available as specific re-stocking methods. Herebelow, these re-stocking methods are successively described.

Insertion Aperture Re-Stocking

Insertion aperture re-stocking is similar to the operations of the above-described deposit transaction and stacking processing. For example, stacked banknotes are separated one by one from the deposit aperture 1 (insertion aperture), and the separated banknotes are conveyed to the banknote verification section 4. A banknote for which the result of verification by the banknote verification section 4 is that the banknote is proper is temporarily withdrawn to the temporary holding section 3, and subsequently stacked in the banknote cassette 6A to 6D corresponding to the denomination thereof. On the other hand, a banknote for which the result of verification by the banknote verification section 4 is that the banknote is abnormal is stacked in the withdrawal aperture 2.

Cassette Replacement Re-Stocking

In cassette replacement re-stocking, the fact that the banknote cassettes 6A to 6D are removable is utilized, and banknotes are re-stocked by one of the banknote cassettes 6A to 6D being replaced with a banknote cassette that is pre-loaded with banknotes. In cassette replacement re-stocking, the denominations and numbers of re-stocked banknotes must be manually registered by an operator.

Cassette Counting Re-Stocking

In cassette counting re-stocking, banknotes are pre-loaded into the banknote storage vault 8 of the banknote cassette 7, and the banknote cassette 7 is installed in the banknote processing device 10. The banknotes are fed one by one from the banknote storage vault 8, and the fed banknotes are conveyed to the banknote verification section 4. A banknote for which the result of verification by the banknote verification section 4 is that the banknote is proper is stacked in the banknote cassettes 6A to 6D in accordance with the denomination thereof. On the other hand, a banknote for which the result of verification by the banknote verification section 4 is that the banknote is abnormal is stacked in the reject vault 9. Thus, in cassette counting re-stocking, a counting process is executed by the banknote verification section 4, and an operator does not have to manually register the denomination and number of the re-stocked banknotes.

—Recovery Operation—

The recovery operation is a basic operation for recovering banknotes from inside the banknote processing device 10. In the banknote processing device 10 according to the present embodiment, withdrawal aperture recovery, cassette replacement recovery and cassette counting recovery are available as specific recovery methods. Herebelow, these recovery methods are successively described.

Withdrawal Aperture Recovery

Withdrawal aperture recovery is similar to the operations of the above-described deposit transaction. For example, first, banknotes are separated one by one from the banknote cassette 6 that is a recovery target, and the separated banknotes are conveyed to the banknote verification section 4. A banknote for which the result of verification by the banknote verification section 4 is that the banknote is proper is stacked in the withdrawal aperture 2. On the other hand, a banknote for which the result of verification by the banknote verification section 4 is that the banknote is abnormal is stacked in the reject vault 9. This process may be applied to all banknotes stacked in the recovery target banknote cassette 6, and an operator may recover the banknotes that are determined to be proper from the withdrawal aperture 2. The banknotes that are determined to be abnormal may also be recovered, from the reject vault 9.

Cassette Replacement Recovery

In cassette replacement recovery, the fact that the banknote cassettes 6A to 6D are removable is utilized, and the recovery task is carried out by removing one of the banknote cassettes 6A to 6D in which banknotes are stacked from the banknote processing device 10. In cassette replacement recovery, an operator takes banknotes out from the banknote cassette 6 that has been removed, and must manually count the denomination and number of the recovered banknotes.

Cassette Counting Recovery

In cassette counting recovery, banknotes are fed one by one from the recovery target banknote cassette 6, and the fed banknotes are conveyed to the banknote verification section 4. Banknotes that are verified by the banknote verification section 4 as being proper are stacked in the banknote storage vault 8 of the banknote cassette 7. On the other hand, banknotes that are verified by the banknote verification section 4 as being abnormal are stacked in the reject vault 9 of the banknote cassette 7.

This process may be applied to all the banknotes stacked in the recovery target banknote cassette 6, and then an operator may recover the banknotes verified as proper and the banknotes verified as abnormal by removing just the banknote cassette 7 from the banknote processing device 10. Thus, in cassette counting recovery, a counting process is executed by the banknote verification section 4, and the operator does not have to manually count the denomination and number of the recovered banknotes.

—2-4. Direct Deposit—

Figure 6:
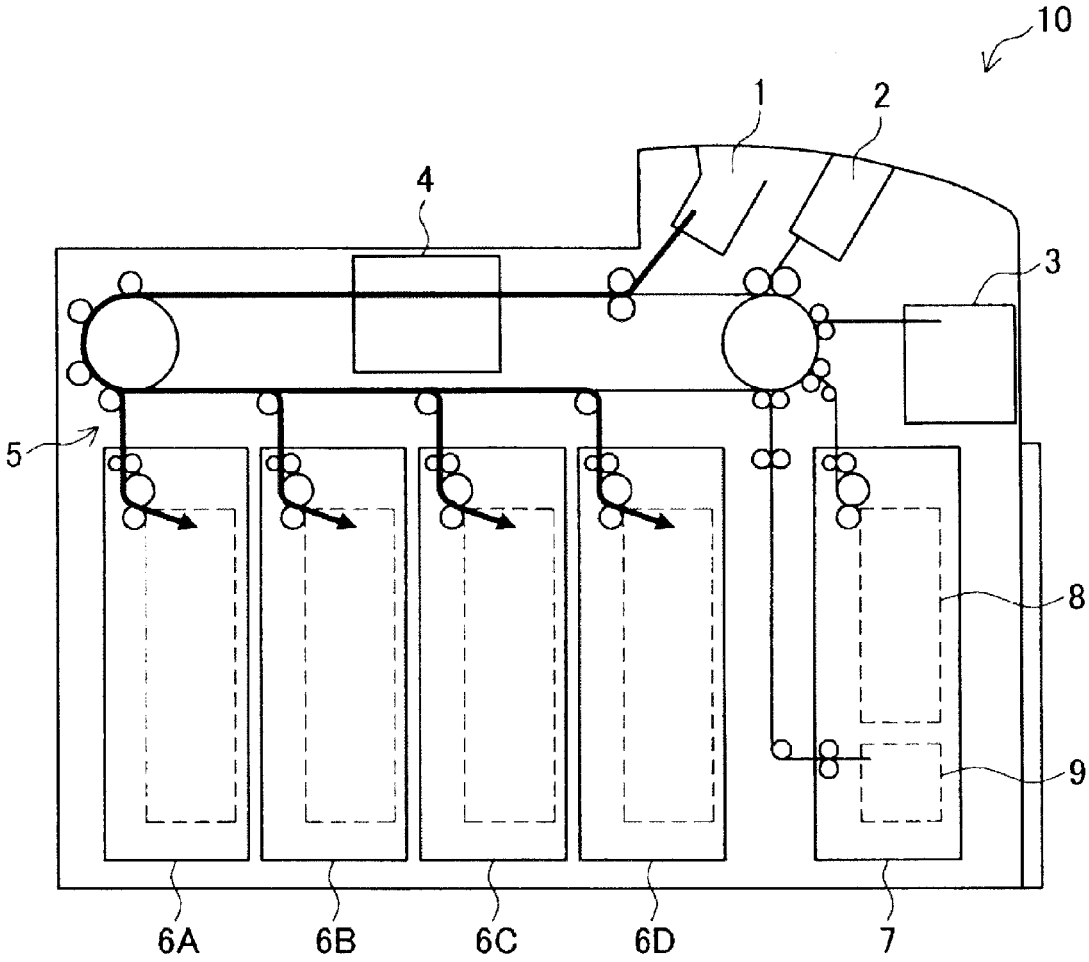
FIG. 6 is a diagram showing conveyance paths in direct deposit processing, until a banknote fed from a deposit aperture is stacked directly in a banknote cassette.

Hereabove, basic operations of the banknote processing device 10 are described. Herein, the operation of a deposit transaction may be, apart from ordinary deposit processing in which deposited banknotes are withdrawn to the temporary holding section 3 and then stacked from the temporary holding section 3 into the banknote cassettes 6, direct deposit processing in which deposited banknotes are stacked directly in the banknote cassettes 6 without being withdrawn to the temporary holding section 3. Herebelow, the direct deposit processing is described with reference to FIG. 6. FIG. 6 is a diagram showing conveyance paths in the direct deposit processing, until banknotes fed one by one from the deposit aperture 1 are stacked in the banknote cassettes 6.

In the direct deposit processing, banknotes are separated one by one from the deposit aperture 1, and each separated banknote is conveyed to the banknote verification section 4. A banknote for which the result of verification by the banknote verification section 4 is that the banknote is proper passes along a path shown by an arrow in FIG. 6 from the banknote verification section 4 and is stacked in the banknote cassettes 6A to 6D in accordance with the denomination thereof. On the other hand, a banknote for which the result of verification by the banknote verification section 4 is that the banknote is abnormal (a reject banknote) is stacked in the withdrawal aperture 2. Banknotes stacked in the withdrawal aperture 2 may be re-inserted at the deposit aperture 1 by a staff member and re-verified.

Thus, in the direct deposit processing, the banknotes are not withdrawn to the temporary holding section 3 but directly stacked in the banknote cassettes 6, and the deposit processing time may be shortened compared to the ordinary deposit processing described above. Moreover, because the banknotes do not need to be withdrawn to the temporary holding section 3 in the direct deposit processing, travel of the banknotes may be reduced, and the probability of a jam occurring may be lowered. Furthermore, according to the direct deposit processing, deposit transactions may be implemented even when the temporary holding section 3 cannot be used due to a malfunction or the like, or in a structure that does not include the temporary holding section 3, or the like.

In the banknote processing device 10 according to the embodiment of the present invention, when a jam occurs during a direct deposit, control is performed such that banknotes for which the banknote storage section has been set as a conveyance destination are directly conveyed to the banknote storage section and banknotes for which no conveyance destination has been set by the banknote verification section are ejected. Thus, banknotes may be stacked in the banknote storage section even when a jam has occurred. Herebelow, this banknote conveyance control according to the embodiment of the present invention is described.

3. OPERATION PROCESSING

—3-1. Banknote Conveyance Control when a Jam Occurs—

Figure 7:
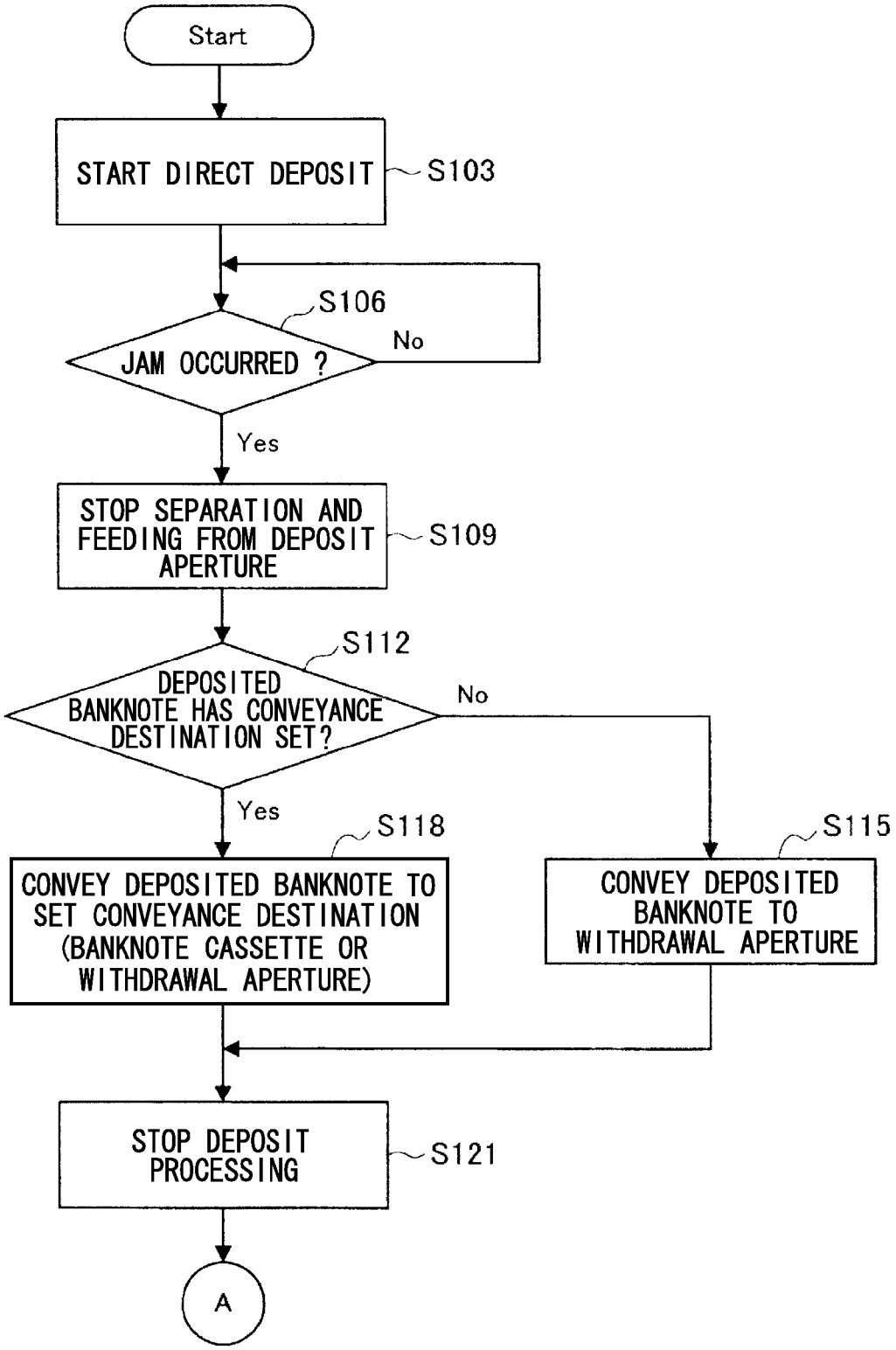
FIG. 7 is a flowchart showing banknote conveyance control when a jam occurs.

FIG. 7 is a flowchart showing the banknote conveyance control according to the present embodiment. As shown in FIG. 7, first, in step S103, the banknote processing device 10 starts a direct deposit in accordance with an instruction from a staff member. Specifically, as described above, the conveyance controller 13 separates (feeds) banknotes stacked in the deposit aperture 1, one by one, and conveys the separated banknotes to the banknote verification section 4. A banknote for which the result of verification by the banknote verification section 4 is that the banknote is proper passes along a path shown by an arrow in FIG. 6 from the banknote verification section 4 and is stacked in the banknote cassettes 6A to 6D in accordance with the denomination thereof. On the other hand, a banknote for which the result of verification by the banknote verification section 4 is that the banknote is abnormal (a reject banknote) is stacked in the withdrawal aperture 2.

Then, if it is detected in step S106 that a jam has occurred in the process of conveyance of the banknotes, in step S109 the conveyance controller 13 stops the separation (and feeding) of banknotes from the deposit aperture 1.

Then, in step S112, when a deposited banknote that is being conveyed is a banknote for which no conveyance destination has yet been set by the banknote verification section 4, in step S115 the conveyance controller 13 controls the conveyance such that this banknote is stacked in the withdrawal aperture 2 (i.e., ejected through the withdrawal aperture 2).

On the other hand, in step S112, when a deposited banknote that is being conveyed is a banknote for which a conveyance destination has been set by the banknote verification section 4, in step S118 the conveyance controller 13 controls the conveyance such that the deposited banknote is stacked in the set conveyance destination (the banknote cassettes 6A to 6D or the withdrawal aperture 2).

In step S121, the banknote processing device 10 stops the deposit processing.

Figure 8:
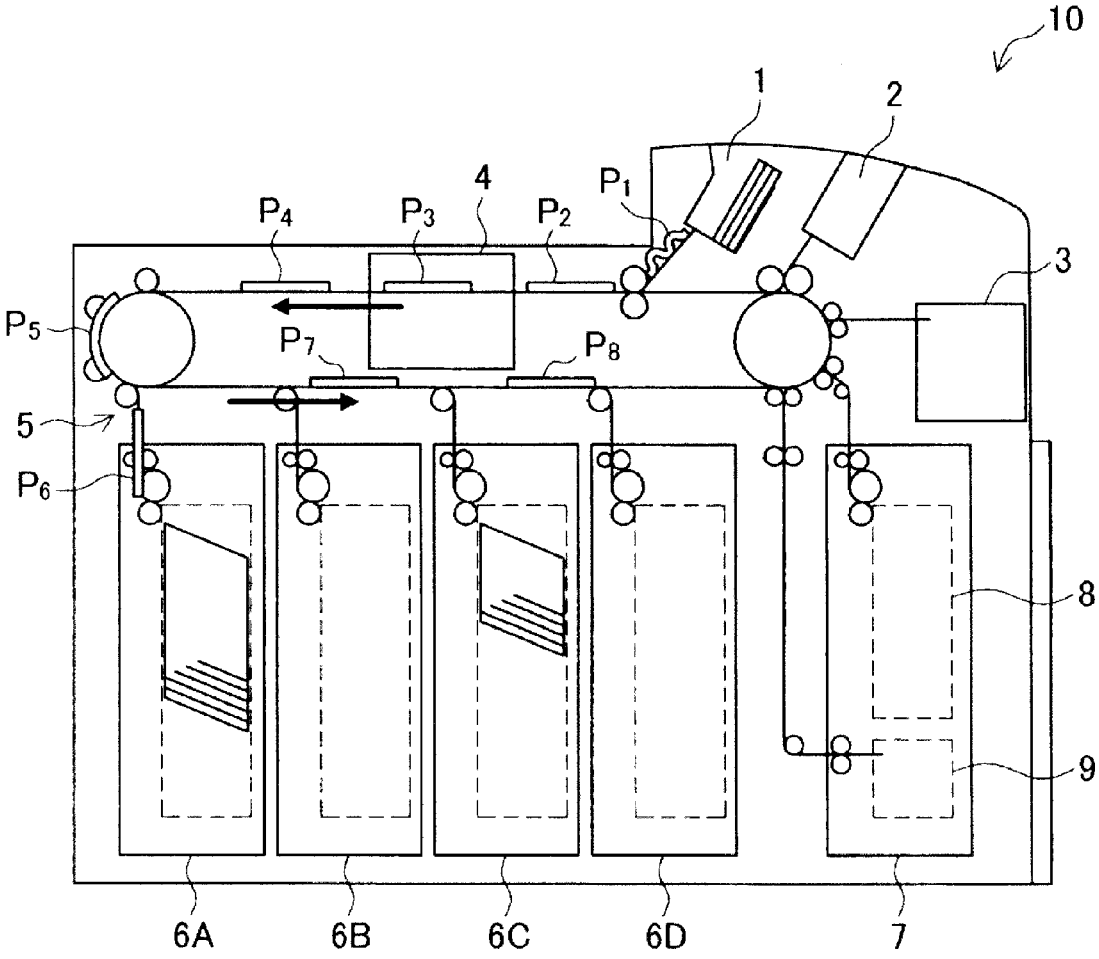
FIG. 8 is a diagram for describing an example of banknote conveyance control when a jam occurs.
Figure 9:
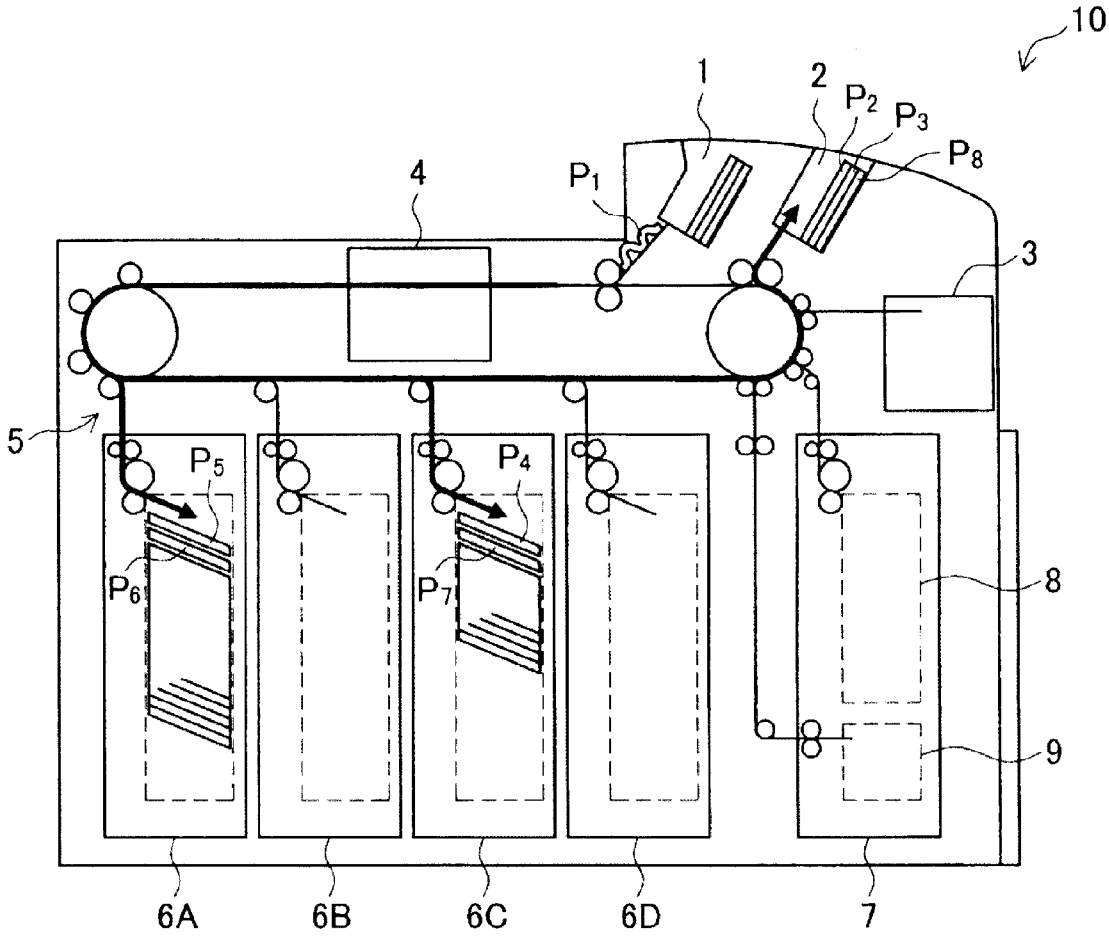
FIG. 9 is a diagram for describing the example of banknote conveyance control when a jam occurs.

Now, the banknote conveyance control shown in step S115 and step S118 is specifically described with reference to FIG. 8 and FIG. 9. FIG. 8 and FIG. 9 are diagrams for describing an example of banknote conveyance control in accordance with the present embodiment.

As shown in FIG. 8, in a direct deposit process, banknotes $P_1$ to $P_8$ are separated from the deposit aperture 1 and conveyed to the banknote verification section 4, and conditions of the banknotes (proper or abnormal) and denominations and the like are identified by the banknote verification section 4. The banknotes that are verified by the banknote verification section 4 as being proper are stacked in the banknote cassettes 6A to 6D in accordance with their denominations.

When the banknote $P_1$ separated from the deposit aperture 1 is jammed in the process of conveyance as shown in FIG. 8, in step S109 as described above, the conveyance controller 13 stops the separation of banknotes from the deposit aperture 1. At this time, of the banknotes $P_2$ to $P_8$ remaining in the conveyance path, banknotes $P_4$ to $P_8$ have already been verified by the banknote verification section 4 and conveyance destinations thereof have been set. On the other hand, banknotes $P_2$ and $P_3$ have not completed verification by the banknote verification section 4 and conveyance destinations thereof have not been set.

As described in step S118 above, the conveyance controller 13 controls the conveyance section 5 (conveyance paths, driving mechanisms and the like) so as to convey the banknotes for which conveyance destinations have been set to the predetermined conveyance destinations. As an example, banknote $P_8$ has been rejected by the banknote verification section 4 and the conveyance destination thereof set to the withdrawal aperture 2. Therefore, as shown in FIG. 9, banknote $P_8$ is stacked in the withdrawal aperture 2. Meanwhile, banknotes $P_4$ to $P_7$ have been verified as proper by the banknote verification section 4 and banknote cassettes have been set as conveyance destinations. Therefore, as shown in FIG. 9, these banknotes are stacked in the banknote cassettes 6A to 6D. Thus, even when a jam has occurred, banknotes for which verification by the banknote verification section 4 has already been completed can be stacked in specified conveyance destinations.

Meanwhile, as described in step S115 above, the conveyance controller 13 stacks banknotes for which no conveyance destination has been set in the withdrawal aperture 2. For example, banknotes $P_2$ and $P_3$ have not been subjected to verification by the banknote verification section 4, and conveyance destinations thereof have not been set. Therefore, as shown in FIG. 9, these banknotes are stacked in the withdrawal aperture 2.

As described hereabove, according to the present embodiment, even when a jam occurs, banknotes for which a banknote cassette has already been set as a conveyance destination may be stacked in the specified banknote cassettes. Thus, there is no need for a staff member to re-deposit these banknotes, and a partial deposit may be completed.

Now, control after the stopping of the deposit processing in step S121 is described.

—3-2. Control after Deposit Processing Stops—

Figure 10:
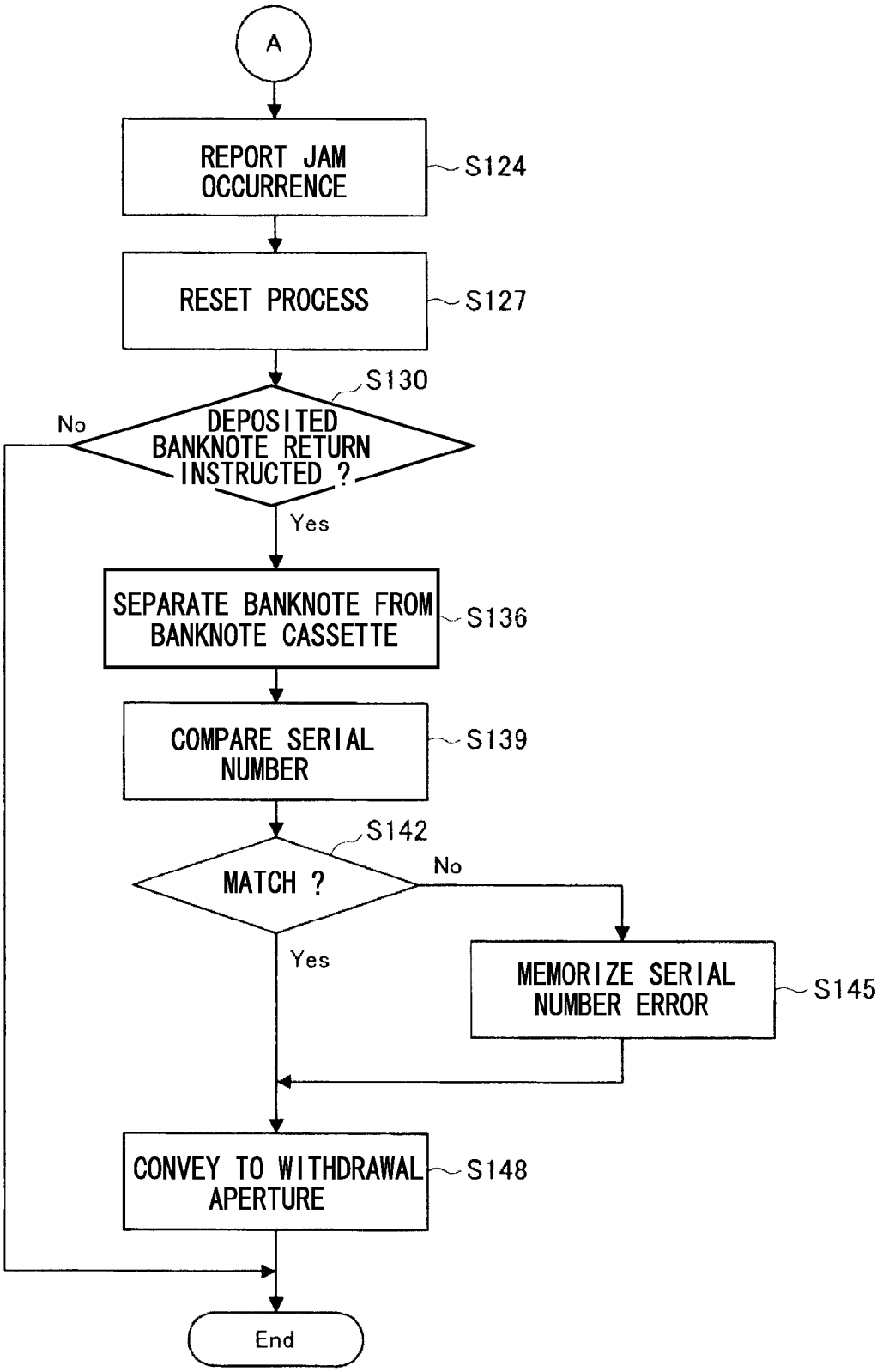
FIG. 10 is a flowchart showing control after deposit processing is stopped in accordance with the present embodiment.

FIG. 10 is a flowchart showing the control after the deposit processing is stopped in accordance with the present embodiment. As shown in FIG. 10, first, in step S124, the controller 11 reports the occurrence of the jam to a staff member. As a specific example, a jam occurrence report screen may be displayed at the display unit 17 of the banknote processing device 10, and an alarm may be sounded. The jam occurrence report screen may also be displayed at a display screen of the service terminal 30 that a staff member is operating, which is connected to the banknote processing device 10.

Then, in step S127, a reset process such as a jammed paper removal operation and restart operation or the like is carried out. As a specific example, a staff member extracts a jammed banknote, checks that there are no banknotes remaining in the conveyance path, and then presses a reset button. The following procedures are presented as examples of a remaining banknote checking procedure.

Checking Procedure (1)

In response to guidance from the banknote processing device 10 (a display screen, voice message or the like), the staff member inserts a single banknote in the deposit aperture 1. The conveyance controller 13 separates this banknote from the deposit aperture 1, passes the banknote through the banknote verification section 4, and ejects the banknote to the withdrawal aperture 2. Thus, whether or not there are any banknotes remaining in the conveyance path may be checked by forcibly conveying a single banknote.

Checking Procedure (2)

Because the jam has occurred during deposit processing, there is a high probability that there are still banknotes in the deposit aperture 1. Accordingly, rather than prompting the staff member to insert a banknote as in the above procedure (1), the conveyance controller 13 separates a single banknote from the deposit aperture 1, passes the banknote through the banknote verification section 4, and ejects the banknote to the withdrawal aperture 2. Thus, in this procedure too, whether or not there are any banknotes remaining in the conveyance path may be checked by forcibly conveying a single banknote.

The reset processing by a staff member described in step S127 is very convenient when the banknote processing device 10 is manned. Alternatively, when the banknote processing device 10 is unmanned, reset processing such as ejection of jammed banknotes and restarting of the device or the like may be carried out automatically.

Next, a case in which a return of the deposited banknotes is instructed after the banknote processing device 10 has restarted is described. As described above, deposited banknotes for which no conveyance destination is set are ejected (returned) while deposited banknotes for which a banknote cassette is set as the conveyance destination are stacked in the respective banknote cassettes, and a partial deposit is completed. Accordingly, if a return of the deposited banknotes is instructed by a staff member, the banknote processing device 10 returns this non-returned portion of the deposited banknotes. Now, description returns to the flowchart of FIG. 10.

If deposited banknote return processing is instructed by a staff member at step S130, in step S136 the conveyance controller 13 separates banknotes from one or more of the banknote cassettes 6 one by one, in accordance with the denominations and numbers of deposited banknotes in the non-returned portion, and controls conveyance such that a separated banknote is conveyed to the banknote verification section 4. The banknote verification section 4 recognizes the denomination, banknote condition and serial number of the banknote. Note that the serial numbers used in the present embodiment are an example of characteristic information that is recognized from the banknotes for identifying the individual banknotes.

Then, in step S139, the comparison section 15 compares the serial number of the banknote recognized by the banknote verification section 4 (characteristic information that is recognized at the time of a second conveyance) with serial numbers of the deposited banknotes that were previously recognized during the direct deposit and memorized in the memory section 12 (characteristic information recognized at the time of a first conveyance). When a result of comparison by the comparison section 15 is that the serial number of the banknote recognized by the banknote verification section 4 (a banknote scheduled for return) does not match the serial number of a deposited banknote, the controller 11 may determine that the banknote scheduled for return is not the actual deposited banknote. On the other hand, when the serial number of a banknote recognized by the banknote verification section 4 (the banknote scheduled for return) matches the serial number of a deposited banknote, the controller 11 may determine that the banknote scheduled for return is the actual deposited banknote.

When the banknote scheduled for return is not the actual deposited banknote, in step S145 the controller 11 performs processing to record a serial number error (for example, memorizing the error in the memory section 12). The controller 11 may also report the error at the display unit 17 of the banknote processing device 10, the service terminal 30 connected thereto or the like. Then, in step S148, the conveyance controller 13 controls the conveyance section 5 so as to convey the banknote scheduled for return from the banknote verification section 4 to the withdrawal aperture 2 and eject the banknote through the withdrawal aperture 2 (i.e., stack the banknote in the withdrawal aperture 2).

On the other hand, when the banknote scheduled for return is an actual deposited banknote, in step S148 the conveyance controller 13 controls the conveyance section 5 so as to convey the banknote scheduled for return from the banknote verification section 4 to the withdrawal aperture 2 and eject the banknote through the withdrawal aperture 2 (i.e., stack the banknote in the withdrawal aperture 2).

Figure 11:
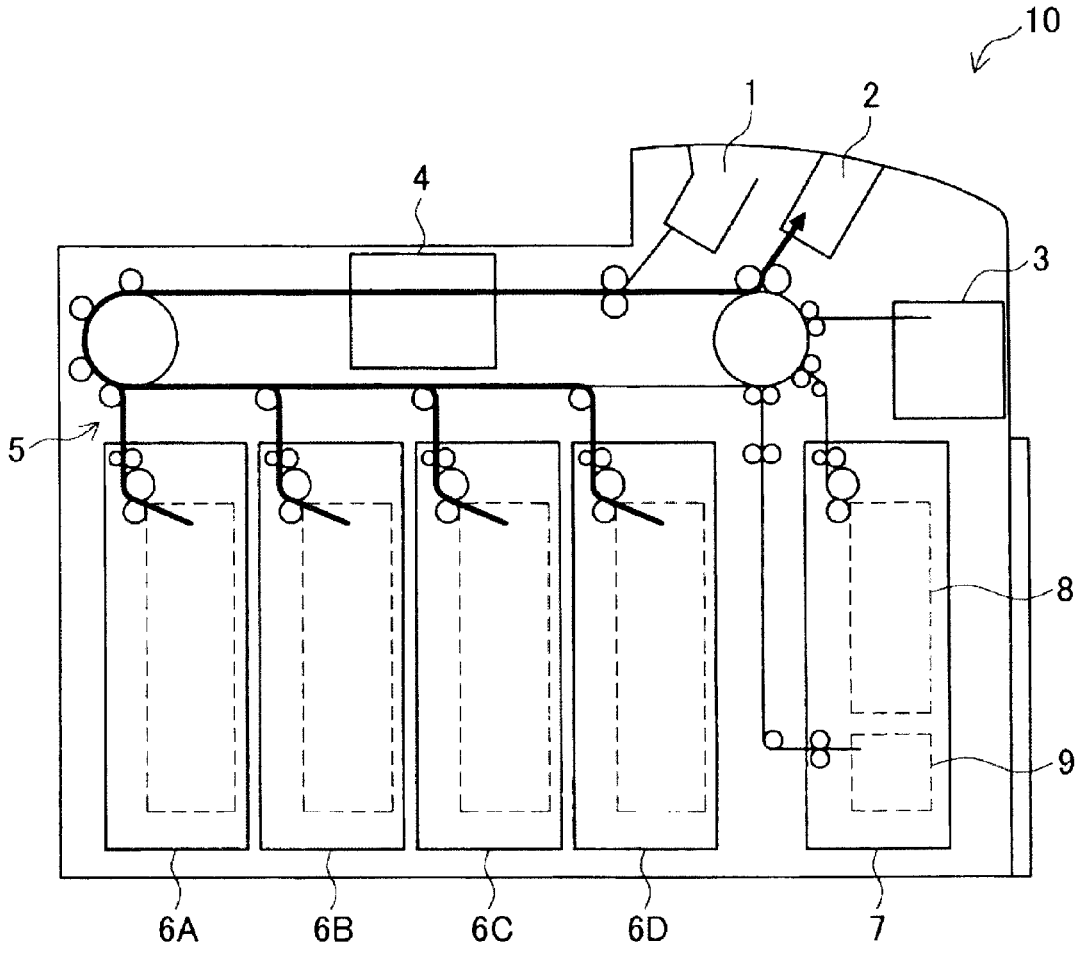
FIG. 11 is a diagram showing conveyance paths of banknotes in accordance with the present embodiment.

Thus, in the deposited banknote return processing according to the present embodiment, banknotes that are determined not to be actual deposited banknotes (having different serial numbers) are returned after a serial number error is memorized. Therefore, in the present embodiment, as well as banknotes that match the actual deposited banknotes, banknotes that do not match (serial number mismatch banknotes) are also conveyed along the path shown by the arrow in FIG. 11 to the withdrawal aperture 2 and returned. In the present embodiment, a staff member may check whether or not the actual deposited banknotes have been assuredly returned from whether there is serial number error information in the memory section 12.

4. CONCLUSION

As is described hereabove, according to the embodiment of the present invention, when a jam occurs during a direct deposit, control is performed such that banknotes for which a banknote storage section has been set as a conveyance destination are conveyed directly to that banknote storage section, and banknotes for which no conveyance destination has been set by the banknote verification section are ejected. Thus, banknotes may be stacked in the banknote storage section even when a jam has occurred.

Further, deposited banknotes of a non-returned portion may be returned after jam reset processing. In this case, the individual banknotes are identified by comparing the serial numbers of the banknotes being returned with the serial numbers of the deposited banknotes that were previously memorized during the direct deposit. Thus, whether or not the banknotes being returned are the actual deposited banknotes may be checked.

A preferable embodiment of the present invention has been described in detail while referring to the attached drawings, but the present invention is not limited to this example. It will be clear to the practitioner having ordinary skill in the field of art to which the present invention belongs that numerous modifications and improvements are possible within the scope of the technical gist recited in the attached claims, and it should be understood that these modifications and improvements are to be encompassed by the technical scope of the invention.

For example, in the embodiment described above, conveyance control when a jam has occurred during a direct deposit is described, but the conveyance control according to the present embodiment is not limited to this. For example, the conveyance control may be applied to a case in which a jam occurs during insertion aperture re-stocking, in which banknotes stacked in the deposit aperture 1 (insertion aperture) are separated one by one, pass through the banknote verification section 4 and, depending on verification results by the banknote verification section 4, are directly stacked into the banknote cassettes 6A to 6D of the corresponding denominations.

A computer program may be prepared that causes hardware such as a CPU, ROM, RAM and the like incorporated in the banknote processing device 10 to realize functions equivalent to the comparison section 15 of the banknote processing device 10 described above. A storage medium on which this computer program is stored may be provided.

The embodiment described above describes application of the banknote processing device 10 according to the present embodiment to a staff-operated terminal, but the banknote processing device 10 according to the present embodiment is not limited thus. For example, the present embodiment may be applied to a cash processing section of a customer-operated terminal, which is an ATM as represented by ATMs of the type in which banknotes are circulated (recycled). These ATMs are installed in numerous locations such as banks, train stations, convenience stores and so forth. A customer may perform transactions such as deposits, withdrawals and balance enquiries by performing various operations on display screens displayed at the ATM.

The disclosures of Japanese Patent Application No. 2011-261195 are incorporated into the present specification by reference in their entirety.

All references, patent applications and technical specifications cited in the present specification are incorporated by reference into the present specification to the same extent as if the individual references, patent applications and technical specifications were specifically and individually recited as being incorporated by reference.

The invention claimed is:

1. A banknote processing device comprising:

an insertion aperture that separates and feeds inserted banknotes;

a banknote verification section that verifies the banknotes fed from the insertion aperture;

a banknote storage section in which the banknotes are stacked;

a temporary holding section for temporarily holding at least one banknote; and a controller that controls conveyance of a first group of the banknotes after the banknotes are conveyed from the insertion aperture to the banknote verification section such that the first group of banknotes are conveyed directly to the banknote storage section without being conveyed to the temporary holding section in accordance with verification results by the banknote verification section, wherein, when a jam occurs in a process of conveying the banknotes, the controller stops the separation and feeding of the banknotes by the insertion aperture, and controls conveyance such that a second group of the banknotes, for which the banknote storage section has been set as a conveyance destination by the banknote verification section, are conveyed directly to the banknote storage section without being conveyed to the temporary holding section, and ejected banknotes, for which no conveyance destination has been set, are ejected.

2. The banknote processing device according to claim 1, further comprising an ejection aperture, wherein, when the jam occurs in the process of conveying the banknotes, the controller controls conveyance so as to eject rejected banknotes of the banknotes that have been verified as abnormal by the banknote verification section and set to be ejected from the ejection aperture.

3. The banknote processing device according to claim 2, wherein, when the cause of the jam has been removed and the banknote processing device has been restarted, the controller performs conveyance control to convey banknotes of a non-returned portion from the banknote storage section to the banknote verification section.

4. A banknote processing device comprising:

an insertion aperture that separates and feeds inserted banknotes;

a banknote verification section that verifies the banknotes fed from the insertion aperture;

a banknote storage section in which the banknotes are stacked; and a controller that controls conveyance of the banknotes after the banknotes are conveyed from the insertion aperture to the banknote verification section such that a first group of the banknotes are conveyed directly to the banknote storage section in accordance with verification results by the banknote verification section, wherein, when a jam occurs in a process of conveying the banknotes, the controller stops the separation and feeding of the banknotes by the insertion aperture, and controls conveyance such that a second group of the banknotes, for which the banknote storage section has been set as a conveyance destination by the banknote verification section, are conveyed directly to the banknote storage section, and ejected banknotes, for which no conveyance destination has been set, are ejected, wherein, when the cause of the jam has been removed and the banknote processing device has been restarted, the controller performs conveyance control to convey banknotes of a non-returned portion from the banknote storage section to the banknote verification section.

5. The banknote processing device according to claim 4, further comprising a comparison section that compares characteristic information recognized at a time of a first conveyance of a third group of the banknotes from the insertion aperture to the banknote verification section with characteristic information recognized at a time of a second conveyance of the third group of banknotes by the conveyance control from the banknote storage section to the banknote verification section.

6. The banknote processing device according to claim 5, further comprising a memory section that, when the comparison section determines that the characteristic information recognized at the time of the second conveyance is different from the characteristic information recognized at the time of the first conveyance, memorizes a characteristic information error, wherein the controller controls conveyance such that the third group of banknotes conveyed from the banknote storage section to the banknote verification section are ejected regardless of the results of the comparison by the comparison section.

7. A banknote processing device comprising:

an insertion aperture that separates and feeds inserted banknotes;

a banknote verification section that verifies the banknotes fed from the insertion aperture;

a banknote storage section for storing at least one banknote;

a temporary holding section for temporarily holding at least one banknote of the banknotes that has been identified by the banknote verification section as being proper but not yet conveyed to the banknote storage section; and a controller that controls conveyance of the banknotes after the banknotes are conveyed from the insertion aperture to the banknote verification section such that a first group of the banknotes are conveyed directly to the banknote storage section without being conveyed to the temporary holding section in accordance with verification results by the banknote verification section, wherein, when a jam occurs in a process of conveying the banknotes, the controller stops the separation and feeding of the banknotes by the insertion aperture, and controls conveyance such that a second group of the banknotes, for which the banknote storage section has been set as a conveyance destination by the banknote verification section, are conveyed directly to the banknote storage section without being conveyed to the temporary holding section, and banknotes, for which no conveyance destination has been set, are ejected.

* * * * *